US006851340B2

(12) United States Patent
Hsien

(10) Patent No.: US 6,851,340 B2
(45) Date of Patent: Feb. 8, 2005

(54) SCREWDRIVER ASSEMBLY

(76) Inventor: Chih-Ching Hsien, 58, Ma Yuan West St., Taichung (TW)

( * ) Notice: Subject to any disclaimer, the term of this patent is extended or adjusted under 35 U.S.C. 154(b) by 46 days.

(21) Appl. No.: 10/402,765

(22) Filed: Mar. 29, 2003

(65) Prior Publication Data

US 2004/0187649 A1 Sep. 30, 2004

(51) Int. Cl.[7] ..... B25G 1/00
(52) U.S. Cl. ..... 81/177.5; 81/177.7
(58) Field of Search ..... 81/177.5, 177.7, 81/177.8

(56) References Cited

U.S. PATENT DOCUMENTS 750,182 A * 1/1904 Furbish ..... 7/168
1,616,300 A * 2/1927 Bido ..... 81/438
2,656,865 A * 10/1953 Bright ..... 81/33
4,271,731 A * 6/1981 Suligoy et al. ..... 81/177.7
6,401,301 B1 * 6/2002 Hung ..... 16/430

* cited by examiner

*Primary Examiner*—Derris H. Banks
*Assistant Examiner*—J Williams

(57) ABSTRACT

A screwdriver assembly includes a handle, a shank mounted on the handle and having a fork-shaped first end formed with two opposite pivot ears and an opening located between the two opposite pivot cars, and a screwdriver head pivotally mounted in the opening of the shank between the two opposite pivot ears. Thus, screwdriver assembly that can save the user's energy and manual work, thereby facilitating the user rotating the screw member.

5 Claims, 6 Drawing Sheets

SCREWDRIVER ASSEMBLY

BACKGROUND OF THE INVENTION

1. Field of the Invention

The present invention relates to a screwdriver assembly, and more particularly to a screwdriver assembly that can save the user's energy and manual work, thereby facilitating the user rotating the screw member.

2. Description of the Related Art

A conventional screwdriver comprises a handle formed with a pivot portion, and a shank pivotally mounted on the pivot portion of the handle. In to such a manner, the shank can be pivoted relative to the handle to adjust the included angle between the shank and the handle, so that the conventional screwdriver can be bent to rotate the screw member mounted on a vertical wall. However, when the shank is vertical to the handle, the length of the force applying arm of the handle is smaller than that of the driven arm of the shank, thereby wasting the user's energy and manual work in rotating the screw member.

SUMMARY OF THE INVENTION

The primary objective of the present invention is to provide a screwdriver assembly that can save the user's energy and manual work, thereby facilitating the user rotating the screw member.

Another objective of the present invention is to provide a screwdriver assembly, wherein the force fulcrum is arranged on the upper end of the shank, so that when the screwdriver assembly is bent, the length of the force applying arm of the handle together with the shank is much greater than that of the driven arm of the upper end of the shank, thereby greatly saving the user's energy and manual work in rotating the screw member.

A further objective of the present invention is to provide a screwdriver assembly, wherein the length of the shank can be reduced, and the user's one hand can hold the handle with the thumb being pressed on an end of the screwdriver head, so that the user can exert a torque on the handle and the screwdriver head, so as to rotate the screw member easily and conveniently.

In accordance with the present invention, there is provided a screwdriver assembly, comprising:

a handle;

a shank mounted on the handle and having a fork-shaped first end formed with two opposite pivot ears and an opening located between the two opposite pivot ears; and a screwdriver head pivotally mounted in the opening of the shank between the two opposite pivot ears.

Further benefits and advantages of the present invention will become apparent after a careful reading of the detailed description with appropriate reference to the accompanying drawings.

DETAILED DESCRIPTION OF THE INVENTION

Figure 1:
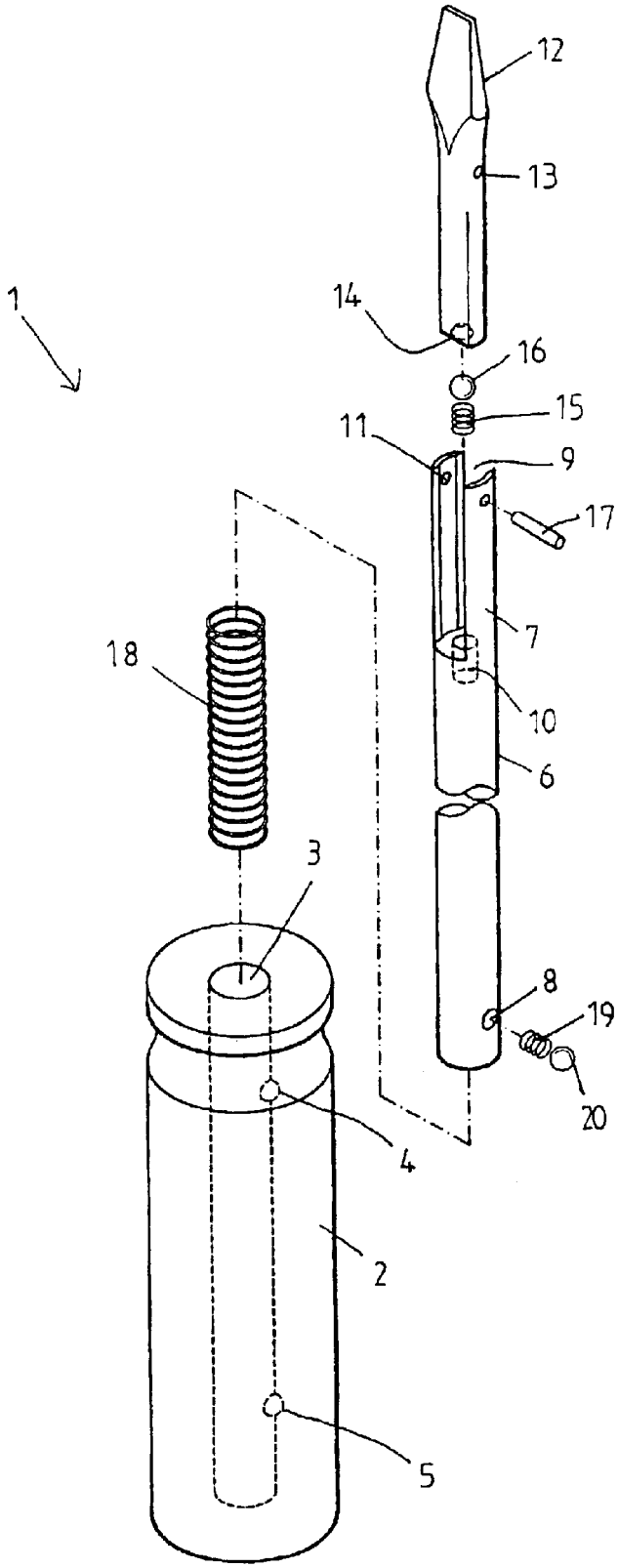
FIG. 1 is an exploded perspective view of the screwdriver assembly in accordance with the first embodiment of the present invention.
Figure 2:
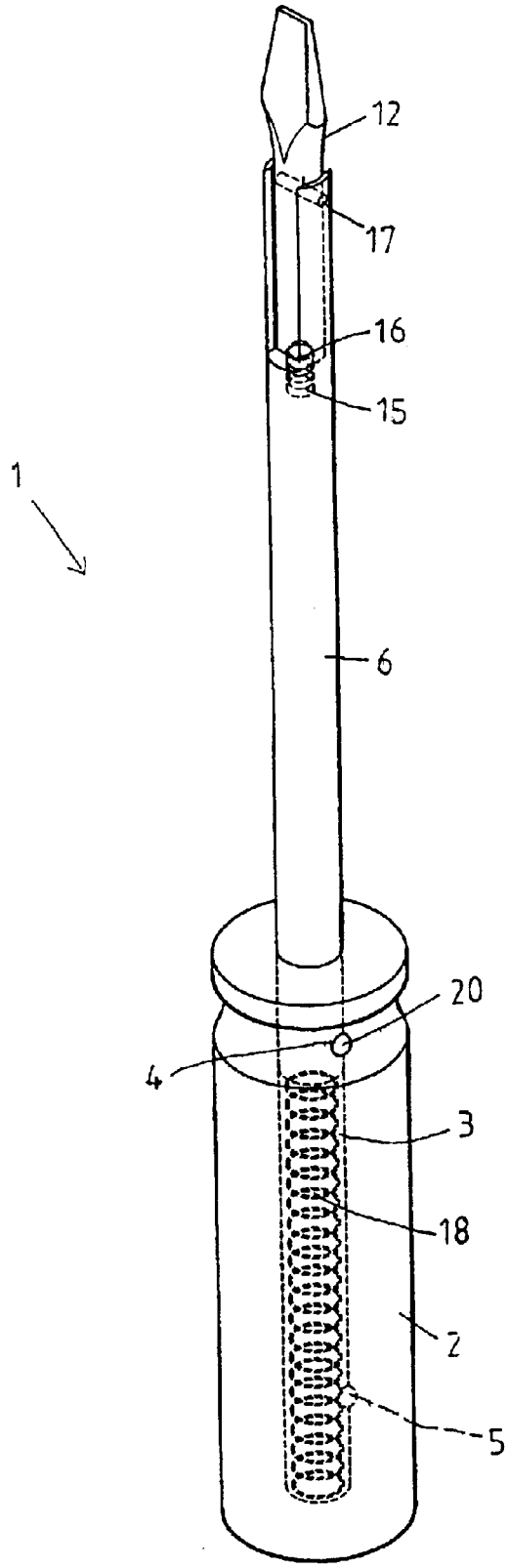
FIG. 2 is a perspective assembly view of the screwdriver assembly in accordance with the first embodiment of the present invention.

Referring to the drawings and initially to FIGS. 1–5, the screwdriver assembly 1 in accordance with the first embodiment of the present invention comprises a handle 2, a shank 6, and a screwdriver head 12.

The handle 2 has an inside formed with a receiving chamber 3. The receiving chamber 3 of the handle 2 has a wall having a first end formed with a first locking cavity 4 and a second end formed with a second locking cavity 5.

The shank 6 is slidably mounted in the receiving chamber 3 of the handle 2. The shank 6 has a fork-shaped first end formed with two opposite pivot ears 7 and an opening 9 located between the two opposite pivot ears 7. Each of the two opposite pivot ears 7 of the shank 6 is formed with a through hole 11. The first end of the shank 6 is formed with a recessed receiving portion 10 communicating with the opening 9. The shank 6 has a second end having a periphery formed with a receiving hole 8. The screwdriver assembly 1 further comprises a spring 18 mounted in the receiving chamber 3 of the handle 2 and urged on the second end of the shank 6.

The screwdriver head 12 is pivotally mounted in the opening 9 of the shank 6 between the two opposite pivot ears 7. The screwdriver head 12 has a first end formed with a pivot hole 13. Preferably, the pivot hole 13 is ldcated adjacent to a mediate portion of the screwdriver head 12. The screwdriver assembly 1 further comprises a positioning pin 17 extended through the through hole 11 of each of the two opposite pivot ears 7 of the shank 6 and the pivot hole 13 of the screwdriver head 12, so that the screwdriver head 12 is pivotally mounted in the opening 9 of the shank 6.

The screwdriver head 12 has a second end formed with an arcuate positioning hole 14. The screwdriver assembly 1 further comprises a first locking ball 16 mounted in the receiving portion 10 of the shank 6 and detachably locked in the positioning hole 14 of the screwdriver head 12, and a first elastic member 1' mounted in the receiving portion 10 of the shank 6 and urged on the first locking ball 16.

The screwdriver assembly 1 further comprises a second, locking ball 20 mounted in the receiving hole 8 of the shank 6 and detachably locked in either one of the first locking cavity 4 and the second locking cavity 5 of the handle 2, and a second elastic member 19 mounted in the receiving hole 8 of the shank 6 and urged on the second locking ball 20.

Figure 3:
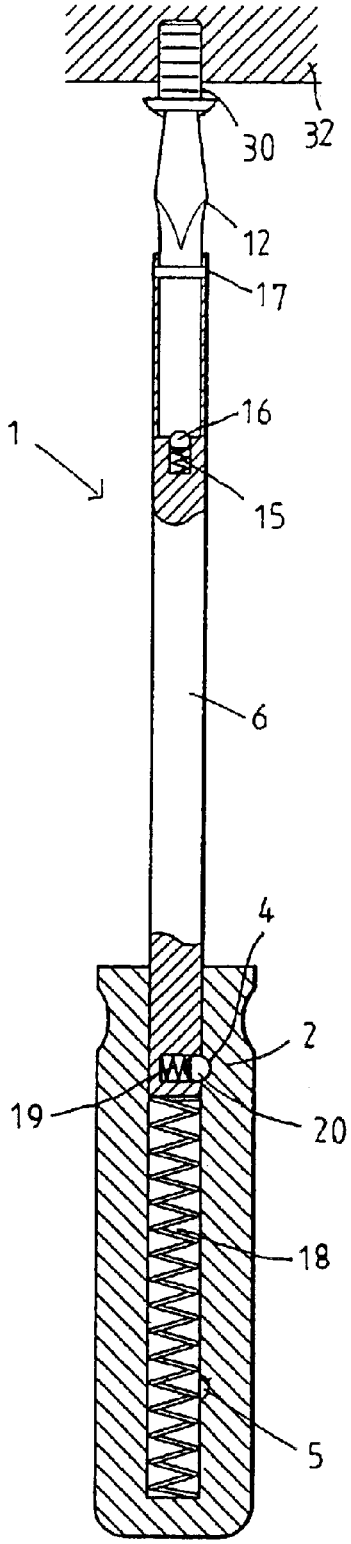
FIG. 3 is a front plan cross-sectional operational view of the screwdriver assembly as shown in FIG. 2.

In operation, as shown in FIG. 3, the screwdriver assembly 1 is used to rotate a screw member 30 mounted on a horizontal wall 32. At this time, the spring 18 is urged on the second end of the shank 6, the second locking ball 20 is locked in the first locking cavity 4 of the handle 2 by the restoring force of the second elastic member 19, and the shank 6 is in line with the screwdriver head 12, so that the screwdriver assembly 1 can be directly used to rotate the screw member 30 mounted on the horizontal wall 32 by rotating the handle 2.

Figure 4:
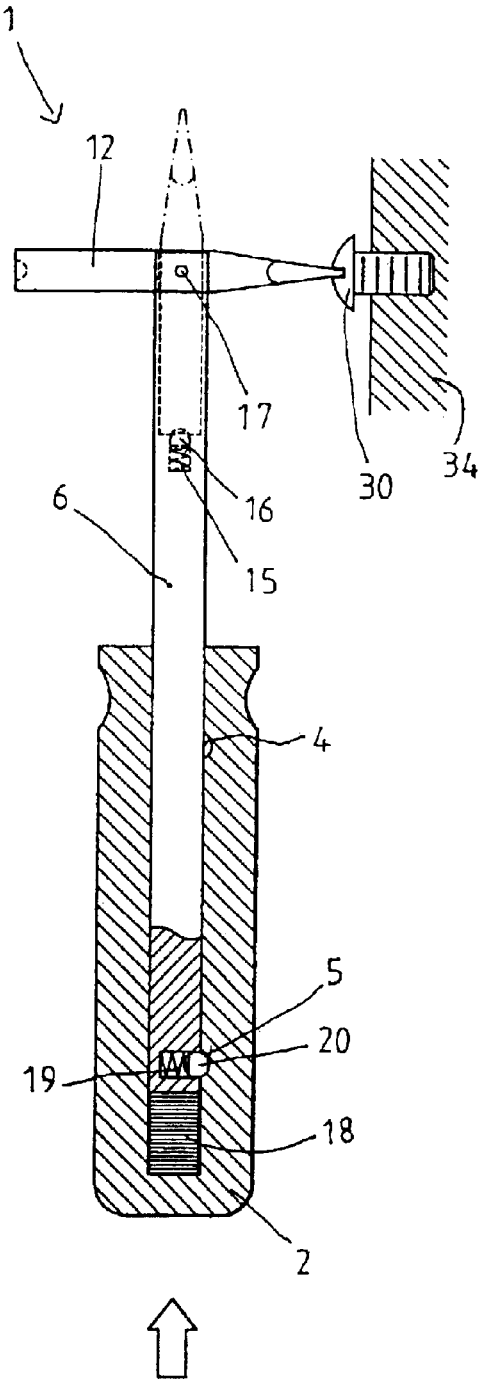
FIG. 4 is a side plan cross-sectional operational view of the screwdriver assembly as shown in FIG. 2.

As shown in FIG. 4, the screwdriver assembly 1 is used to rotate the screw member 30 mounted on a vertical wall 34. At this time, the screwdriver head 12 is rotated about the positioning pin 17 relative to the two opposite pivot ears 7 of the shank 6 until the screwdriver head 12 is vertical to the shank 6 as shown in FIG. 4, so that the screwdriver assembly 1 can be used to rotate the screw member 30 mounted on the vertical wall 34 by turning the shank 6 relative to the screwdriver head 12.

Figure 5:
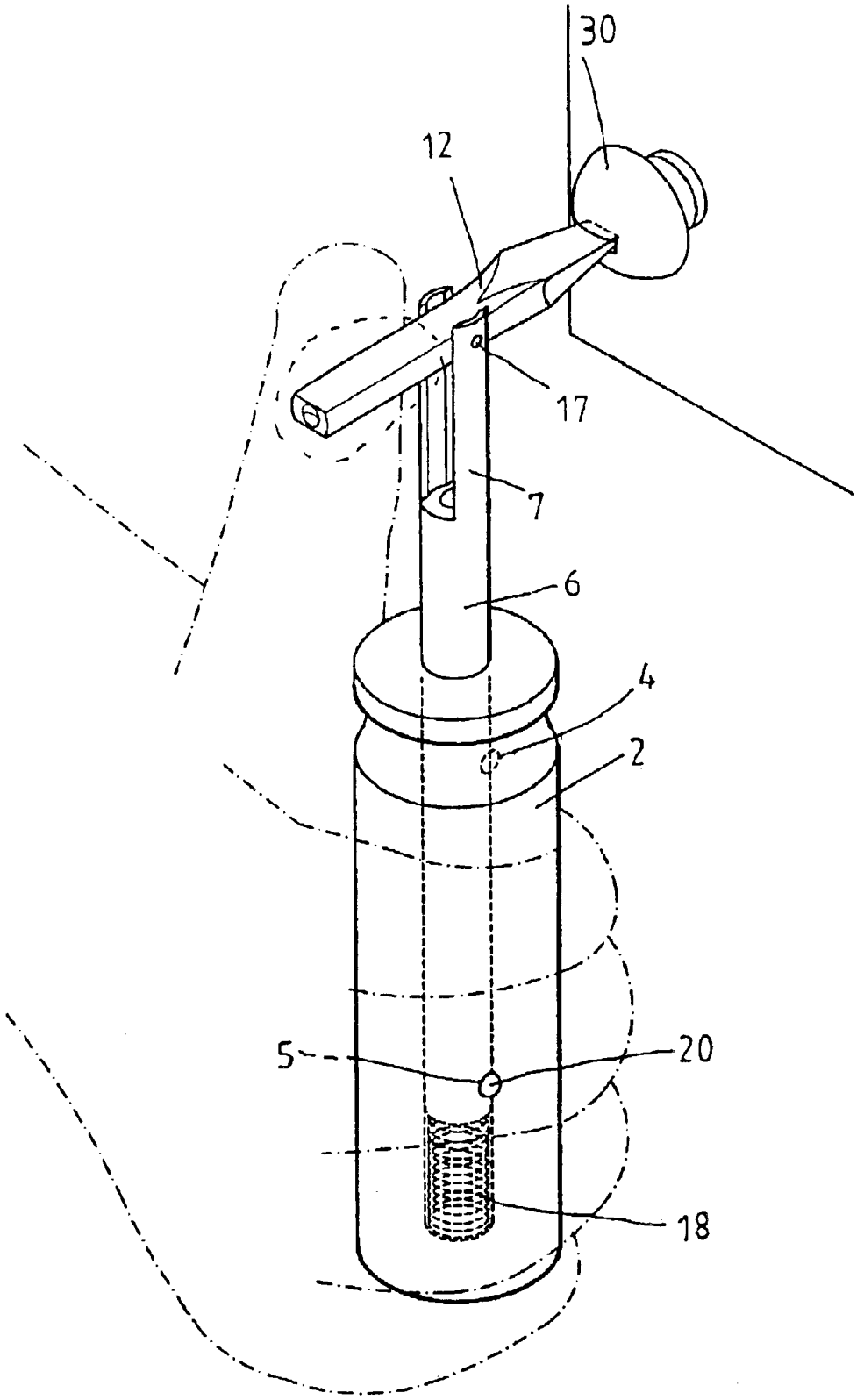
FIG. 5 is a schematic operational view of the screwdriver assembly as shown in FIG. 2.
Figure 7:
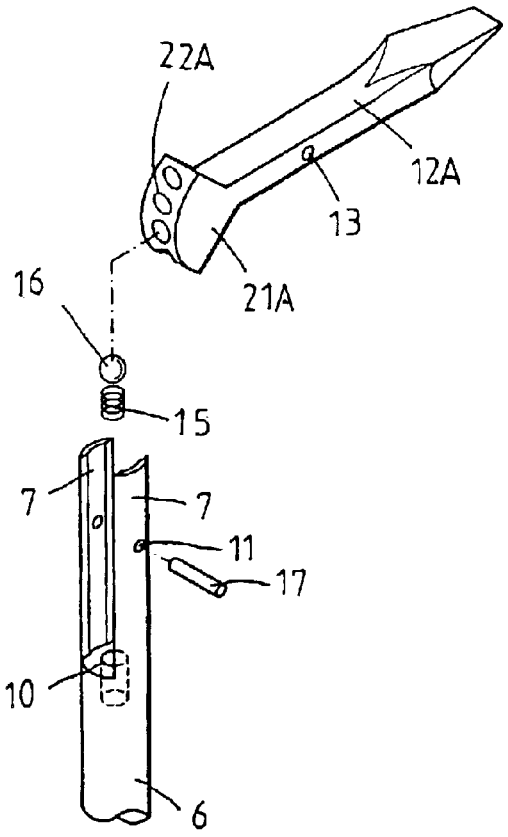
FIG. 7 is a partially cut-away exploded perspective view of the screwdriver assembly as shown in FIG. 6.
Figure 6:
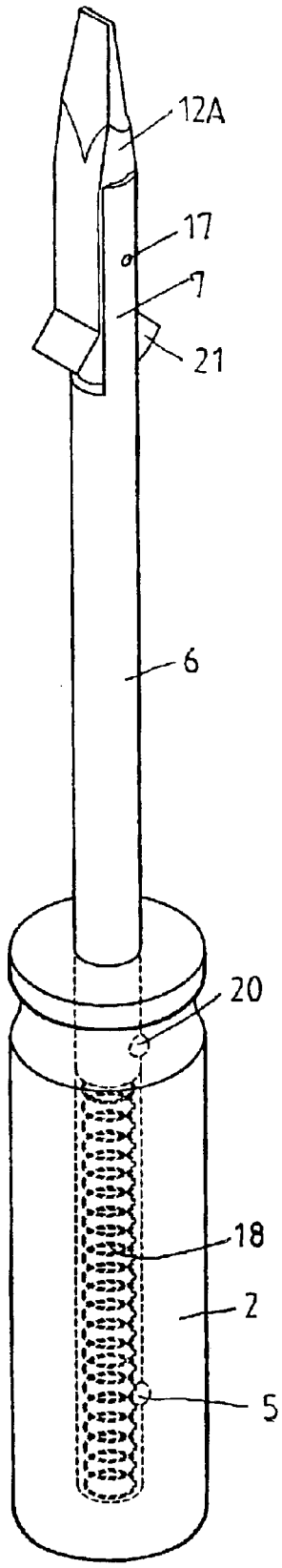
FIG. 6 is a perspective assembly view of the screwdriver assembly in accordance with the second embodiment of the present invention.

As shown in FIG. 5, the shank 6 is retracted into the receiving chamber 3 of the handle 2 until the second locking ball 20 is locked in the second locking cavity 5 of the handle 2 by the restoring force of the second elastic member 19, so that the length of the shank can be reduced. At this time, the user's one hand holds the handle 2 with the thumb being pressed on the second end of the screwdriver head 12, so that the user can exert a torque on the handle 2 and the screwdriver head 12, so as to rotate the screw member 30' easily and conveniently.

Referring to FIGS. 6–9, the screwdriver assembly in accordance with the second embodiment of the present invention is substantially similar to the first embodiment of the present invention, and the difference therebetween is described as follows.

Figure 8:
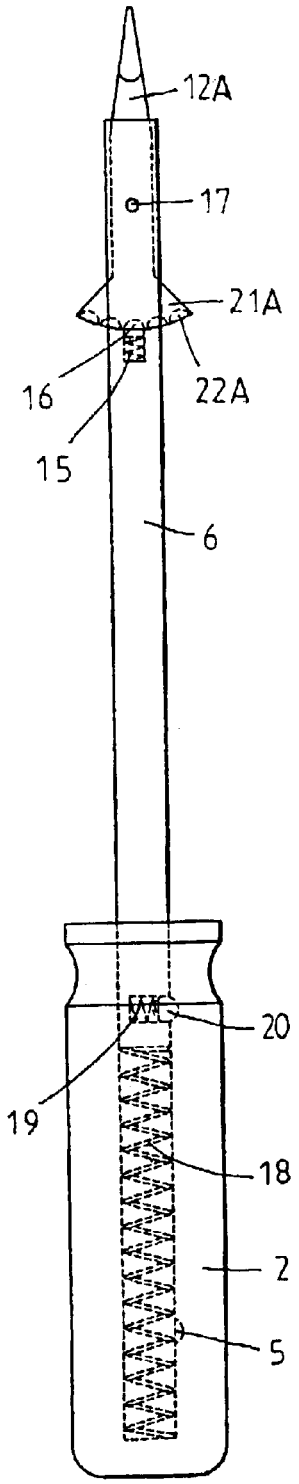
FIG. 8 is a side plan cross-sectional view of the screwdriver assembly as shown in FIG. 6.
Figure 9:
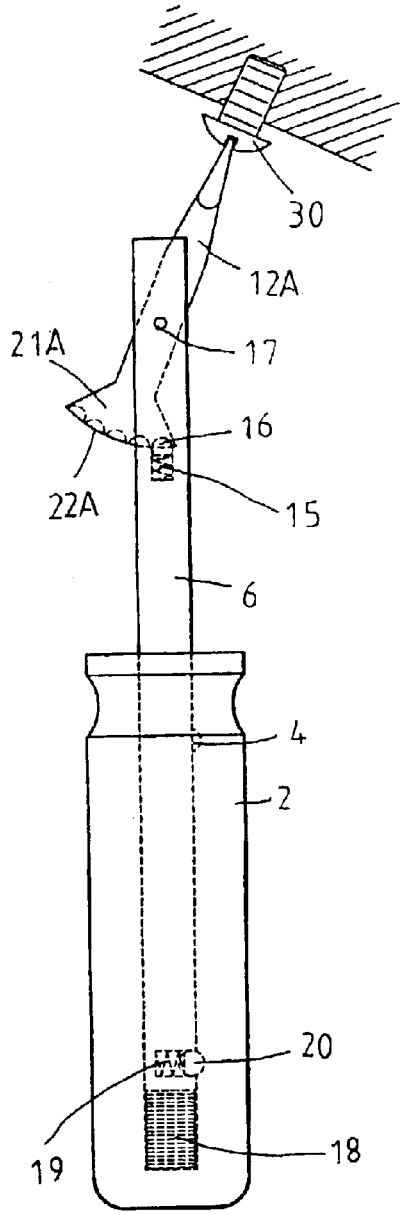
FIG. 9 is a side plan cross-sectional operational view of the screwdriver assembly as shown in FIG. 6.

The screwdriver head 12A has a second end formed with an arcuate positioning block 21A formed with a plurality of positioning holes 22A, and the first locking ball 16 is locked in one of the positioning holes 22A of the screwdriver head 12A, so that the included angle between the shank 6 and the screwdriver-head 12A can be adjusted arbitrarily as shown in FIGS. 8 and 9, thereby facilitating the user rotating the screw member 30.

Although the invention has been explained in relation to its preferred embodiment(s) as mentioned above, it is to be understood that many other possible modifications and variations can be made without departing from the scope of the invention. It is, therefore, contemplated that the appended claim or claims will cover such modifications and variations that fall within the true scope of the invention.

What is claimed is:

1. A screwdriver assembly, comprising:

a handle;

a shank mounted on the handle and having a fork-shaped first end formed with two opposite pivot ears and an opening located between the two opposite pivot ears; and a screwdriver head pivotally mounted in the opening of the shank between the two opposite pivot ears; wherein the handle has an inside formed with a receiving chamber, and the shank is slidably mounted in the receiving chamber of the handle;

the receiving chamber of the handle has a wall having a first end formed with a first locking cavity and a second end formed with a second locking cavity, the shank has a second end having a periphery formed with a receiving hole; and the screwdriver assembly further comprises a locking ball mounted in the receiving hole of the shank and detachably locked in either one of the first locking cavity and the second locking cavity of the handle, an elastic member mounted in the receiving hole of the shank and urged on the locking ball, and a spring mounted in the receiving chamber of the handle and urged on the second end of the shank.

2. The screwdriver assembly in accordance with claim 1, wherein each of the two opposite pivot ears of the shank is formed with a through hole, the screwdriver head has a first end formed with a pivot hole, and the screwdriver assembly further comprises a positioning pin extended through the through hole of each of the two opposite pivot ears of the shank and the pivot hole of the screwdriver head, so that the screwdriver head is pivotally mounted in the opening of the shank.

3. The screwdriver assembly in accordance with claim 2, wherein the pivot hole is located adjacent to a mediate portion of the screwdriver head.

4. A screwdriver assembly comprising:

a handle;

a shank mounted on the handle and having a fork-shaped first end formed with two opposite pivot ears and an opening located between the two opposite pivot ears; and a screwdriver head pivotally mounted in the opening of the shank between the two opposite pivot ears;

wherein the first end of the shank is formed with a recessed receiving portion communicating with the opening, the screwdriver head has a second end formed with an arcuate positioning hole, and the screwdriver assembly further comprises a locking ball mounted in the receiving portion of the shank and detachably locked in the positioning hole of the screwdriver head, and an elastic member mounted in the receiving portion of the shank and urged on the locking ball.

5. A screwdriver assembly comprising:

a handle;

a shank mounted on the handle and having a fork-shaped first end formed with two opposite pivot ears and an opening located between the two opposite pivot ears; and a screwdriver head pivotally mounted in the opening of the shank between the two opposite pivot ears;

wherein the first end of the shank is formed with a recessed receiving portion communicating with the opening, the screwdriver head has a second end formed with an arcuate positioning block formed with a plurality of positioning holes, and the screwdriver assembly further comprises a locking ball mounted in the receiving portion of the shank and detachably locked in one of the positioning holes of the screwdriver head, and an elastic member mounted in the receiving portion of the shank and urged on the locking ball.

* * * * *